US006613402B2

(12) United States Patent
Fulton

(10) Patent No.: US 6,613,402 B2
(45) Date of Patent: Sep. 2, 2003

(54) METHOD OF CONSTRUCTING NATURAL FOLIAGE MODEL VEGETATION

(75) Inventor: C. Dwayne Fulton, Osage Beach, MO (US)

(73) Assignee: Osment Models, Inc., Linn Creek, MO (US)

( * ) Notice: Subject to any disclaimer, the term of this patent is extended or adjusted under 35 U.S.C. 154(b) by 0 days.

(21) Appl. No.: 09/946,875

(22) Filed: Sep. 5, 2001

(65) Prior Publication Data

US 2003/0041944 A1 Mar. 6, 2003

(51) Int. Cl.[7] ..... A41G 1/00
(52) U.S. Cl. ..... 428/18; 428/22; 156/61
(58) Field of Search ..... 428/8, 18, 20, 428/22; 156/61

(56) References Cited

U.S. PATENT DOCUMENTS 3,525,659 A 8/1970 Ebihara
4,082,586 A 4/1978 Osment
4,202,922 A 5/1980 Osment
4,278,481 A 7/1981 Osment
4,859,510 A 8/1989 Rademacher
5,019,431 A 5/1991 Osment et al.
5,215,793 A 6/1993 Osment et al.
5,221,565 A 6/1993 Johnson
5,678,297 A * 10/1997 Liao ..... 428/20

FOREIGN PATENT DOCUMENTS

DE 3225257 A1 * 1/1984

* cited by examiner

*Primary Examiner*—Jeff H. Aftergut
(74) *Attorney, Agent, or Firm*—Stinson Morrison Hecker LLP; J. David Wharton

(57) ABSTRACT

A method for constructing model vegetation utilizing natural foliage and the products resulting therefrom are described. The method includes the steps of providing a segment of natural foliage, immersing the natural foliage into a liquid colorant, and applying leaf simulating material to the natural foliage. For larger model vegetation or for model vegetation requiring a base, a tree armature is utilized with additional steps including removing the branches from the natural foliage and affixing those branches to the tree armature.

33 Claims, 3 Drawing Sheets

FIG. 1.
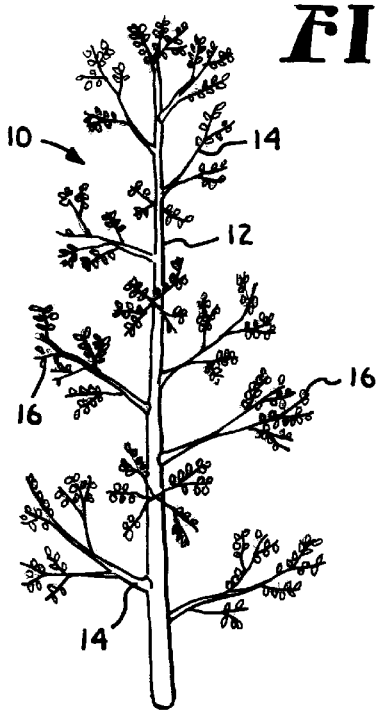
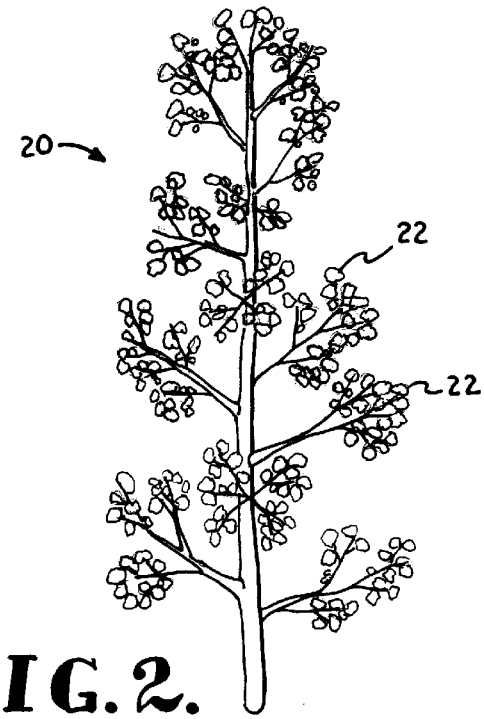
FIG. 2.
FIG. 3.
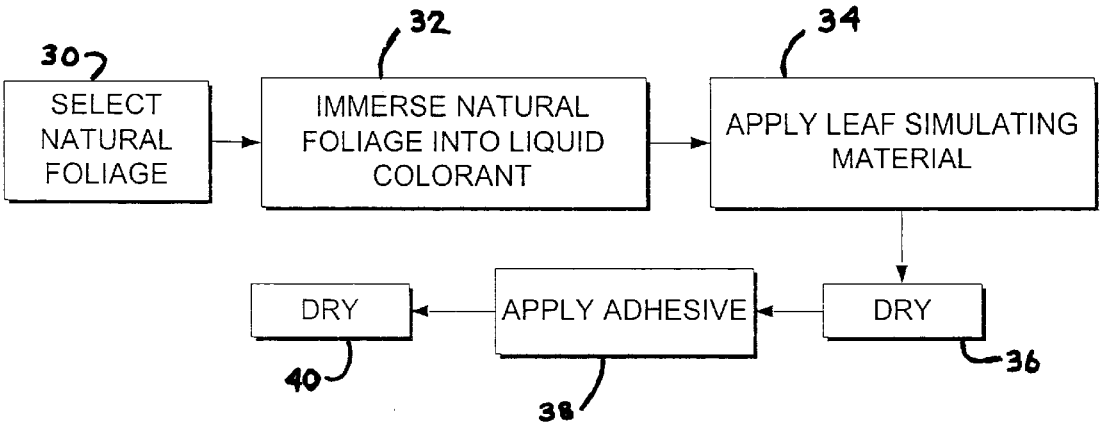

FIG.4.
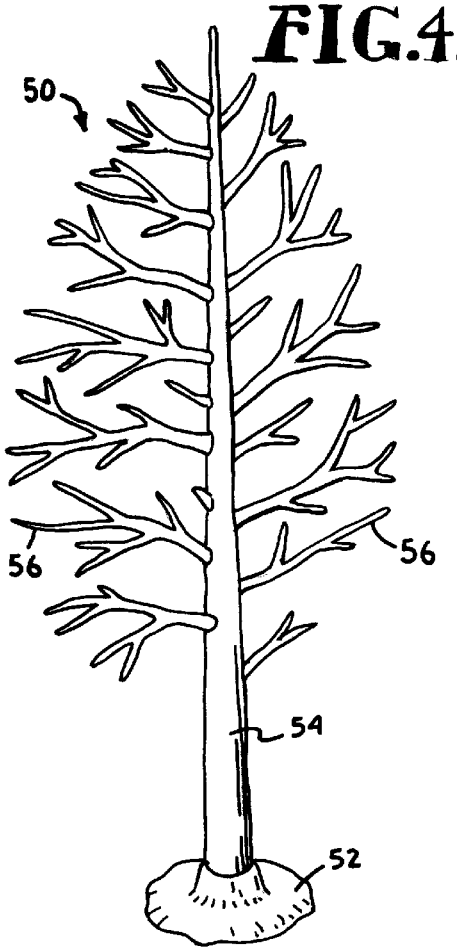
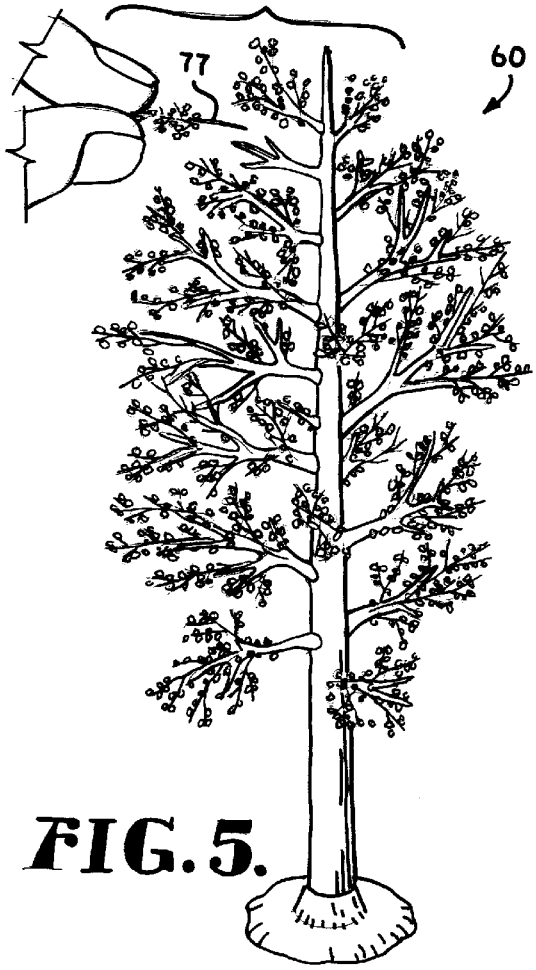
FIG.5.
FIG.7.
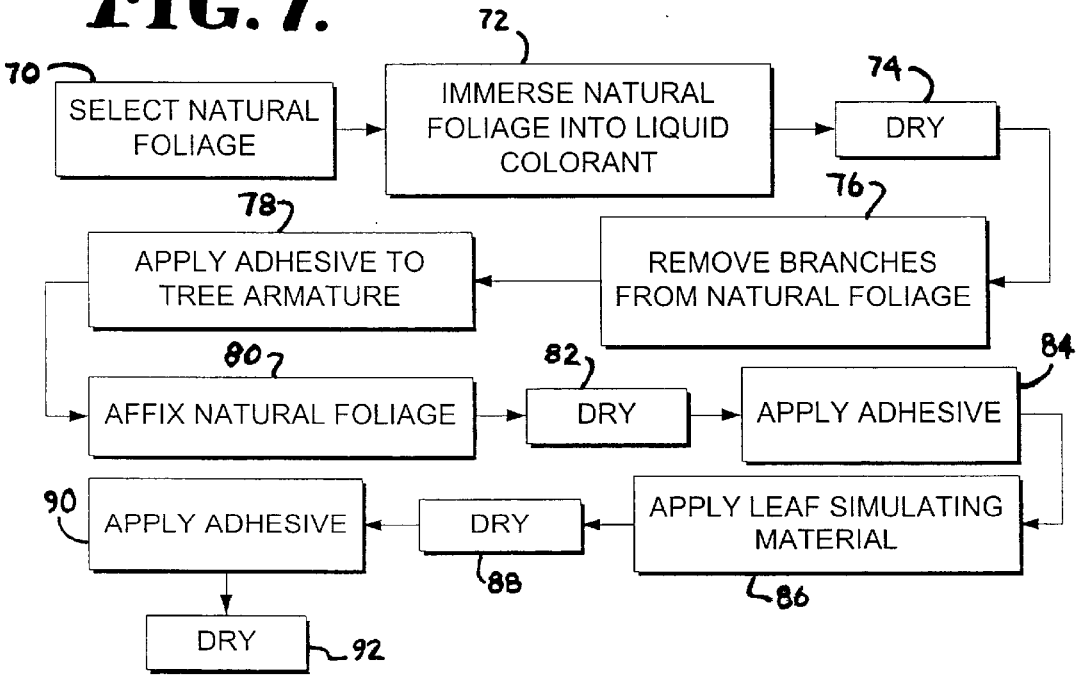

METHOD OF CONSTRUCTING NATURAL FOLIAGE MODEL VEGETATION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates generally to the construction of reproductions of natural landscapes and, more specifically, to a method of constructing natural foliage model vegetation and to the natural foliage model vegetation.

Reproductions of natural landscapes find many uses, from architectural models to battle field scenes to model railroad displays. Realistic model trees, bushes and other vegetation are an important part of creating lifelike reproductions.

Several methods exist for producing realistic model trees. One such method is described in U.S. Pat. No. 5,215,793 issued to the present inventors. The method described in this patent includes binding a mass of ground rubber-like particles together with an adhesive solution, drying the mass on a molding surface and then gluing the resulting member to a trunk and limb representing structure. Another method for producing realistic model trees is found in U.S. Pat. No. 4,278,481 issued to one of the present inventors. The method described in this patent includes a leaf simulating material of ground rubber-like foam particles to a substrate of non-ferrous light-penetrable fibrous material. Although these methods produce generally acceptable model trees, there are applications for which the resulting trees are not sufficiently realistic.

Accordingly, it is an object of the present invention to provide model vegetation and a method for constructing same wherein the model vegetation is more realistic in appearance than those currently available.

It is also an object of the present invention to provide model vegetation and a method for constructing same wherein natural foliage is used as a component.

Further objects of this invention will be apparent to persons knowledgeable with products of this general type upon reading the following description and examining the accompanying drawings.

SUMMARY OF THE INVENTION

A method for constructing model vegetation utilizing natural foliage and the products resulting therefrom are described. The method includes the steps of providing a segment of natural foliage, immersing the natural foliage into a liquid colorant, and applying leaf simulating material to the natural foliage. For larger model vegetation or for model vegetation requiring a base, a trunk armature is utilized with additional steps including removing the branches from the natural foliage and affixing those branches to the trunk armature.

DESCRIPTION OF THE DRAWINGS

In the accompanying drawings, which form a part of the specification and are to be read in conjunction therewith, and in which like reference numerals are used to indicate the parts in the various views:

FIG. 1 is a side elevation view of a segment of natural foliage;

FIG. 2 is a side elevation view of a natural foliage model plant without a trunk armature;

FIG. 3 is an illustration of the steps involved in constructing a natural foliage model plant without a trunk armature according to the method of the present invention;

FIG. 4 is a side elevation view of a trunk armature;

FIG. 5 is a side elevation view of a trunk armature with natural foliage branches affixed and being affixed.

FIG. 7 is an illustration of an alternative set of steps for constructing natural foliage model plant with a trunk armature.

DETAILED DESCRIPTION OF THE INVENTION

Figure 6:
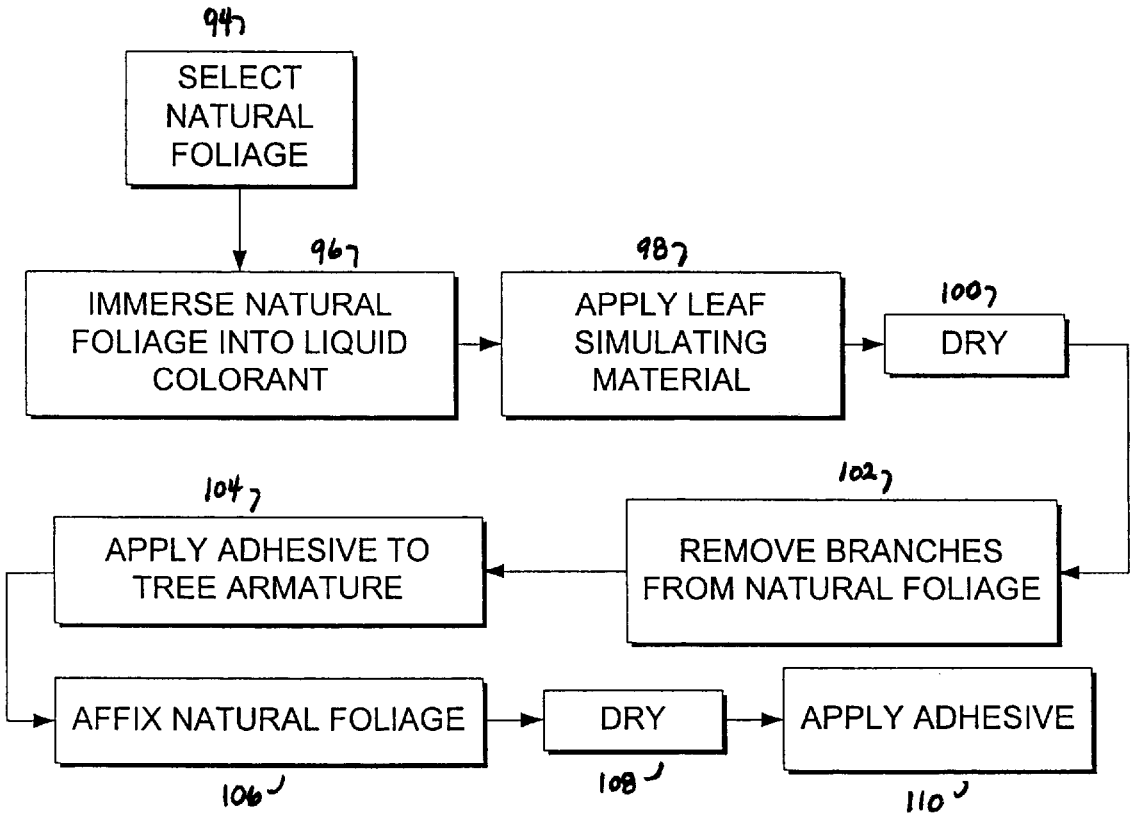
FIG. 6 is an illustration of the steps involved in constructing a natural foliage model plant with a trunk armature according to the method of the present invention.

The first step in constructing model vegetation according the present invention is to select a segment of natural foliage of appropriate size for the model tree desired. If the model vegetation is to be made without a tree armature, such as when a small tree or bush or a tree with a thin trunk is desired, the segment of natural foliage chosen should be the same size as the model desired. If the model vegetation is to be made with a tree armature, such as when a larger tree or a tree with a thicker trunk is desired or if the tree requires a base, then the segment of natural foliage should be chosen for the number of branches it contains, that is, the segment or segments should contain enough branches to complete the construction. For either situation, the segment of natural foliage should be rigid, thin and lightweight. It is preferable that the segment of natural foliage be dehydrated. If the segment is not dehydrated, then it should be dried before proceeding. One example of a plant well suited for this task is chenopodiaceae aristata teloxys.

FIG. 1 depicts a segment of natural foliage, and specifically chenopodiaceae aristata teloxys, generally designated by the numeral 10, for use in the present invention. The natural foliage 10 shown consists of a stem 12 with a number of branches 14 attached. The branches 14 are of various lengths and may divide into smaller branches. Several dried florets 16 are coupled to each branch 14. The florets 16 are not a necessary part of the natural foliage.

Turning first of all to the construction of natural foliage model vegetation which does not employ an armature structure, the steps for carrying out the method of the present invention are shown in FIG. 3. The first step is indicated at station 30 and comprises selecting an appropriate segment of natural foliage which, as previously discussed, is preferably chenopodiaceae aristata teloxys. This natural foliage is moved to station 32 where it is subjected to a liquid colorant, preferably through immersion. In addition to providing color to the natural foliage, the liquid colorant insures that the natural foliage is flexible and strong enough to support the leaf simulating material added later in the invention. The preferred colorant is a colored polymer which may be thinned with water so that it does not extend from branch to branch after it is applied to the natural foliage. If thinning is necessary, the ratio of colored polymer to water should be between 1:1 and and preferably 1:1. Both latex paint and oil base paint thinned with an appropriate thinner such as mineral spirits may also be utilized. Grey, black, brown and white colors are preferred but other colors may also be utilized to simulate further variations of natural foliage.

Following the immersion of the foliage at station 32, the material is moved to station 34 where a leaf simulating material is applied. It is important that the foliage be moved to station 34 before the colorant dries so that the colorant will adhere the leaf simulating material. The preferred leaf simulating material is a resilient foam, such as polyurethane, urethane or latex which has been ground or shredded to achieve particles of the desired size and which has been colored a natural color, usually one or more shades of natural vegetation. Two different sizes have been employed for the ground foam particles, specifically, a large size that is large enough to pass over a number #24 mesh screen and small enough to pass through a #8 mesh screen and a small size that is large enough to pass over a number #24 mesh screen and small enough to pass through a #0 mesh screen. Thus the ground foam should be large enough to pass over a number 24 mesh screen and small enough to pass through a larger size screen.

The preferred method for an individual to apply the material at station 34 is to sprinkle the material over the natural foliage so that the material will stick to the liquid colorant, covering at least some of the branches 14. If the model vegetation is being mass produced, then a mechanism, such as a tumbler, may be employed. The leaf simulating material 22 may be applied at different densities to achieve different appearances in the final product. The leaf simulating material 22 is preferably applied in an irregular non-uniform fashion in order to present the appearance of a complex foliage pattern.

When the application of the leaf simulating material 22 is complete, the model tree structure is moved to drying station 36 which is preferably an air dry, although a slightly elevated temperature may be employed to speed up the drying process. Next, the model tree structure is moved to station 38 where an adhesive or fixative is applied. Adhesives or fixatives which may be utilized at this station include resin glues, hair spray, or clear coat laquer. A spray application is preferred. Once the adhesive has been applied, the model tree structure is moved to station 40 where it is further dried so as to complete the model tree structure 20. (FIG. 2).

Construction of a natural foliage model tree structure employing a trunk armature is illustrated in the schematic of FIG. 6. The first step in the process is to select natural foliage which is indicated at station 94 and comprises the same considerations as discussed above in conjunction with the alternative method. The natural foliage material is moved to station 96 where it is subjected to a liquid colorant as previously described at station 32 of the alternative embodiment. Next, at station 98, leaf simulation material is affixed to the natural foliage as previously described at station 34 of the alternative embodiment. The natural foliage is then moved to station 100 where it is dried.

Once dried, the foliage material is moved to station 102 where the branches are removed from the limbs. The preferred method for an individual to remove the branches is to manually grasp the bottom of the stem 12 and pull on the stem through a thumb and finger held tightly against the stem. Another method of removing the branches is to manually remove each individual branch by breaking it away from the stem. This technique may also be employed to remove any branches remaining after the foliage is stripped utilizing the first method described. Yet another method of removing the branches is to employ a mechanism containing a slot with the natural foliage being pulled through the slot. The individual removed branches have been designated by the numeral 77 in FIG. 5.

Next, at station 104, an adhesive is applied to a trunk armature in a similar manner as previously described at station 38 for the alternative method. The various alternative adhesives previously mentioned are applicable to this process, although at this station the preferred adhesive is a water based contact cement. Methylene chloride is another adhesive that may be utilized at this station.

A trunk armature is shown in FIG. 4 and designated generally by the numeral 50. Trunk armature 50 includes a base 52 that receives a trunk 54. Trunk armature 50 may be formed to simulate the trunk and branches of a tree, a bush or other plant. A number of limbs 56 extend from the trunk. Preferably, the armature is made of deformable, flexible plastic although other materials including metal alloys may be employed. The plastic is preferably characterized by the ability to be formed in a substantially two dimensional shape and then bent or twisted to form a more or less random three dimensional shape.

The prepared natural foliage material previously described along with the trunk armature 50 are both moved to station 106 where the foliage material is affixed to the armature. Following the application of adhesive at station 104, branches 77 of natural foliage are affixed to the branches of the trunk armature as indicated in FIG. 5. Manifestly, the branches 77 need to be applied to the armature before the adhesive applied at station 104 is dry. The individual branches 77 are moved into contact with the limbs of armature 50 where they will adhere as a result of the previously applied adhesive. The adhesive binds the natural foliage branches 77 to the limbs 56 of armature 50. Next, the partially completed artificial plant structure is moved to station 108 where it is allowed to dry. It then advances on to station 110 where a second quantity of adhesive is applied to the partially completed structure. This application of adhesive is carried out as previously described in conjunction with station 104 of the present method and station 38 of the alternative embodiment. Once this is accomplished, the natural foliage branches 77, the leaf simulating material 22 and the armature 50 are formed into a cohesive unitary structure. The artificial plant structure employing armature 50 is thus complete and ready for use.

An alternative method of constructing model vegetation with a trunk armature is illustrated in the schematic of FIG. 7. In this method, the first step is in the process is to select natural foliage which is indicated at station 70 and comprises the same considerations as discussed above in conjunction with the alternative method. The natural foliage material is moved to station 72 where it is subjected to a liquid colorant as previously described at station 32 of the alternative embodiment. The natural foliage is then allowed to dry at station 74. Once dried, the foliage material is moved to station 76 where the branches are removed from the limbs as described above at station 102 of the alternative method.

Next, at station 78, an adhesive is applied to a trunk armature in the same manner as previously described at station 104 for the alternative method. The various alternative adhesives previously mentioned are applicable to this process and again a water based contact cement is the preferred adhesive.

The prepared natural foliage material previously described along with the armature 50 are both moved to station 80 where the foliage material is affixed to the armature. Following the application of adhesive 78, branches 77 of natural foliage are affixed to the branches of the trunk armature as indicated in FIG. 5. Manifestly, branches 77 need to be applied to the armature before the adhesive applied at station 78 is dry.

Next, the partially completed structure is moved to station 82 where it is allowed to dry. It then advances on to station 84 where a second quantity of adhesive is applied to the partially completed structure. This application of adhesive is carried out as previously described in conjunction with station 78 of the present method and station 38 of the alternative embodiment. The preferred adhesive at this station is again water based contact cement.

Next, the structure is moved to station 86 where a leaf simulating material is applied before the adhesive applied at the previous station has dried. The leaf simulating material and the manner of applying it are the same as described in conjunction with the alternative embodiment at station 34. The partially completed tree structure is then moved to station 88 where it is allowed to dry.

The structure is next moved to station 90 where a third quantity of adhesive is applied in the same manner as previously described in conjunction with station 38 of the alternative embodiment. Once this is accomplished, the structure is moved to station 92 where is it allowed to dry and the natural foliage branches 77, the leaf simulating material 22 and the armature 50 are formed into a cohesive unitary structure. The artificial plant structure, such as tree 20, employing armature 50 is thus complete and ready for use.

It will be seen from the foregoing that this invention is one well adapted to attain the ends and objects set forth above, and to attain other advantages which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter shown in the accompanying drawings or described hereinabove is to be interpreted as illustrative and not limiting.

What we claim is:

1. A method of constructing a model plant structure for use in a reproduction of a natural landscape, said method comprising the steps of:

selecting a segment of natural foliage having a number of branches depending therefrom;

providing a quantity of liquid colorant;

applying said liquid colorant to said segment of natural foliage;

providing a quantity of leaf simulating material;

applying said leaf simulating material to said branches; and drying said liquid colorant thereby fixing said leaf simulating material to said branches.

2. A method as set forth in claim 1, wherein said step of selecting a segment of natural foliage includes allowing said segment of natural foliage to dry.

3. A method as set forth in claim 1, wherein said natural foliage is characterized by a relatively thick trunk and branches extending from said trunk.

4. A method as set forth in claim 3, wherein said step of selecting a segment of natural foliage comprises selecting a segment of chenopodiaceae aristata teloxys.

5. A method as set forth in claim 1, wherein said step of providing a quantity of liquid colorant comprises providing a quantity of water dispersable polymer.

6. A method as set forth in claim 1, wherein said step of applying said liquid colorant to said natural foliage comprises immersing said natural foliage in said liquid colorant.

7. A method as set forth in claim 1, wherein said step of providing a quantity of leaf simulating material comprises providing a quantity of ground resilient foam.

8. A method as set forth in claim 7, wherein said step of providing a quantity of leaf simulating material comprises providing a leaf simulating material with particles characterized by a size large enough to pass over a #24 mesh screen and while passing through a larger mesh screen.

9. A method as set forth in claim 1, wherein said step of applying said leaf simulating material to said branches comprises sprinkling said leaf simulating material over said branches.

10. A method as set forth in claim 1, further comprising the steps of:

providing a quantity of adhesive; and applying said adhesive to said segment of natural foliage.

11. A method as set forth in claim 10, wherein said step of providing a quantity of adhesive comprises providing a quantity of contact adhesive.

12. A method as set forth in claim 11, wherein said step of applying said adhesive to said natural foliage comprises spraying said adhesive on said natural foliage.

13. A method as set forth in claim 1, wherein said plant structure comprises a model tree.

14. A model plant structure for use in a reproduction of a natural landscape, said model plant structure made according to the method of any one of the claims 1–13.

15. A method of constructing a model plant structure for use in a reproduction of a natural landscape, said method comprising the steps of:

selecting a segment of natural foliage characterized by a plurality of branches;

providing a quantity of liquid colorant;

applying said liquid colorant to said natural foliage segment;

removing said branches from said natural foliage;

providing a trunk armature;

providing a quantity of adhesive; and affixing said branches to said trunk armature with said adhesive.

16. A method as set forth in claim 15, wherein said step of selecting a segment of natural foliage comprises drying said segment.

17. A method as set forth in claim 16, wherein is included the steps of:

providing a leaf simulating material; and affixing said leaf simulating material to said branches of said segment after said segment has dried.

18. A method as set forth in claim 17, wherein said affixing of said leaf simulating material occurs prior to said removing step.

19. A method as set forth in claim 17, wherein said affixing of said leaf simulating material occurs subsequent to affixing said branches to said trunk armature.

20. A method as set forth in claim 15, wherein said step of selecting a segment of natural foliage comprises selecting a segment of chenopodiaceae aristata teloxys.

21. A method as set forth in claim 15, wherein said step of providing a quantity of liquid colorant comprises providing a quantity of water dispersable polymer.

22. A method as set forth in claim 15, wherein said step of applying said liquid colorant to said natural foliage comprises immersing said natural foliage in said liquid colorant.

23. A method as set forth in claim 15, wherein said step of removing said branches from said natural foliage comprises stripping said branches from said foliage.

24. A method as set forth in claim 15, wherein said step of providing a trunk armature comprises:

providing an armature characterized by the ability to be deformed into a three dimensional shape; and deforming said armature into a three dimensional shape.

25. A method as set forth in claim 15, wherein said step of providing a quantity of leaf simulating material comprises providing a quantity of ground resilient foam.

26. A method as set forth in claim 15, wherein said step of providing a quantity of leaf simulating material comprises providing a leaf simulating material with particles characterized by a size large enough to pass over a #24 mesh screen and small enough to pass through a larger mesh screen.

27. A method as set forth in claim 15, wherein said step of applying said leaf simulating material to said natural foliage comprises sprinkling said leaf simulating material over said natural foliage.

28. A method as set forth in claim 15, wherein said step of providing a quantity of adhesive comprises providing a quantity of contact adhesive.

29. A method as set forth in claim 15, wherein said step of affixing said branches with said adhesive comprises spraying said adhesive on said trunk armature.

30. A method as set forth in claim 15, comprising the additional steps of:

applying adhesive to said trunk armature and branches of natural foliage; and allowing said adhesive to set.

31. A method as set forth in claim 15, wherein said method comprises a method of constructing a model tree structure and said step of providing a trunk armature comprises providing a tree armature.

32. A method as set forth in claim 31, wherein the step of applying said liquid colorant to said natural foliage comprises immersing said natural foliage in said colorant.

33. A model tree structure for use in a reproduction of a natural landscape, said model tree structure made according to the method of any one of the claims 15–32.

* * * * *

UNITED STATES PATENT AND TRADEMARK OFFICE

CERTIFICATE OF CORRECTION

PATENT NO. : 6,613,402 B2
DATED : September 2, 2003
INVENTOR(S) : C. Dwayne Fulton It is certified that error appears in the above-identified patent and that said Letters Patent is hereby corrected as shown below:

Column 2,
Line 26, insert -- vegetation -- between “model” and “desired”.
Line 63, insert -- 3:1 -- between “and” and “and”.

Signed and Sealed this

Sixth Day of January, 2004

JAMES E. ROGAN
*Director of the United States Patent and Trademark Office*